US005366596A

United States Patent [19]

Taciuk et al.

[11] Patent Number: 5,366,596

[45] Date of Patent: * Nov. 22, 1994

[54] DRY THERMAL PROCESSOR

[75] Inventors: William Taciuk; Roderick Caple; Sean Goodwin; Gordon Taciuk, all of Calgary, Canada

[73] Assignee: Alberta Oil Sands Technology and Research Authority, Edmonton, Canada

[ * ] Notice: The portion of the term of this patent subsequent to Jun. 8, 2010 has been disclaimed.

[21] Appl. No.: 73,438

[22] Filed: Jun. 9, 1993

[51] Int. Cl.[5] ..... C10B 1/10

[52] U.S. Cl. ..... 202/100; 165/81; 165/88; 202/136; 202/267.1; 202/268; 432/251; 432/116

[58] Field of Search ..... 202/100, 136, 216, 218, 202/267.1, 268; 165/81, 88; 110/246; 432/251, 107, 116

[56] References Cited

U.S. PATENT DOCUMENTS

| | | | |
|---|---|---|---|
| 1,561,735 | 11/1925 | Lucas | 202/136 |
| 3,408,969 | 11/1968 | Maurice | 110/246 |
| 3,430,936 | 3/1969 | Metzger | 165/88 |
| 3,918,893 | 11/1975 | Whitaker | 165/81 |
| 4,280,879 | 7/1981 | Taciuk | 202/100 |
| 4,285,773 | 8/1981 | Taciuk | 202/100 |
| 4,730,564 | 3/1988 | Abboud | 110/246 |
| 5,088,856 | 2/1992 | Yocum | 110/246 |

*Primary Examiner*—Joye L. Woodard

*Attorney, Agent, or Firm*—Millen, White, Zelane & Branigan

[57] ABSTRACT

The processor is of the type incorporating horizontal, concentric, co-extensive inner and outer tubular members which rotate together. The processor is modified in the following respects:

The front end of the inner tubular member is circumferentially corrugated and may be provided in the form of a plurality of parallel tubes arranged in a ring array, to thereby increase the shell area to promote heat transfer through the tube walls;

Means are provided for interconnecting the tubular members, which means can accommodate differing rates of thermal expansion; and a rock recycle tube assembly is provided to recover oversize material leaving the corrugated portion of the inner tubular member and reject it from the processor.

5 Claims, 6 Drawing Sheets

DRY THERMAL PROCESSOR

CROSS-REFERENCE TO RELATED APPLICATION

This application is related to U.S. patent application Ser. No. 07/511,904, filed Apr. 23, 1990, now U.S. Pat. No. 5,217,578, issued Jun. 8, 1993.

BACKGROUND OF THE INVENTION (1) Field of the Invention

The present invention pertains in one aspect to an improved version of a dry thermal processor for extracting volatile substances from a particulate host material. The processor is of the type incorporating horizontal, concentric, substantially co-extensive, inner and outer tubular members which are interconnected and which rotate together about a horizontal axis. The feedstock enters at one end of the inner tubular member, advances through it, and is heated by hot solids returning through the annular space between the tubes.

In another aspect, the invention pertains to an improved version of the process wherein the feedstock is initially advanced through the inner tubular member and is heated in two stages, firstly to vaporize water contained in the feedstock and secondly to pyrolyse hydrocarbons and produce coked solids. The coked solids are transferred into the annular space, wherein the coke is burned to produce hot solids. Part of the hot solids is recycled into the hydrocarbon vaporization or reaction zone to provide needed heat for that zone. The balance of the hot solids is returned through the annular space and is used to transfer heat into the water vaporization or pre-heat zone by contact with the wall of the inner tubular member.

(2) Prior Art

The present invention relates to improved versions of the processor and the process disclosed in U.S. Pat. Nos. 4,280,879 and 4,285,773. This processor is known as the "ATP Processor".

The present application incorporates by reference the description of co-pending U.S. application Ser. No. 07/511,904, filed Apr. 23, 1990 by Taciuk et al.

The invention has to do with means for interconnecting the inner and outer tubular members. Those tubular members are subjected to different thermal environments, which create difficulties in their interconnection.

For completeness, a description of the difficulties and the efforts at solution made previously, leading to the present invention, are summarized herein.

The ATP Processor comprises inner and outer, generally tubular members herein referred to as tubes. The tubes are generally coextensive, concentric, spaced apart and horizontal. They are interconnected so as to form a unitary rotatable tube assembly. Stationary end frames seal the first and second ends of the outer tube. Drive means are provided for rotating the outer tube, and thus the entire tube assembly, about its longitudinal axis.

The arrangement and extraction process which takes place within the inner and outer tubes defines a plurality of environments which must each deal physically with particulate solids and variable temperatures. The general arrangement and purpose of these environments is described in the following.

A passageway extends longitudinally through the inner tube and an annular space is formed between the tubes. The inner tube passageway is closed at its first end by a stationary end frame and at the second end by a vertical closure plate. It is divided along its length by an upright baffle, thereby creating two segregated sequential chambers or "zones" which combine to extend between the first and second ends of the inner tube. The zone at the first end is referred to as the "preheat zone" and that at the second end as the "vaporization zone".

A feed stream comprising particulate solids may be fed into the first end of the preheat zone by means of a conveyor extending through the first end stationary end frame. As the tube assembly is rotated, this feed is advanced longitudinally through the inner tube passageway. As it is advanced, the feed is simultaneously cascaded and heated by heat exchange with the wall of the inner tube. The inner tube is heated by hot solids and flue gases moving countercurrently through the annular space. As a result of progressive heating of the feed during its advance through the preheat zone, the solids rise in temperature and contained water is vaporized. The produced steam is suctioned out of the preheat zone. The preheated feed is discharged from the preheat zone through helical chutes extending through the baffle. The chutes lead into the vaporization zone. On entering the vaporization zone, the preheated feed is mixed with hot solids recycled from the annular space. As a result, the feed is now heated to a relatively high temperature. The hydrocarbon associated with the solids is therefore vaporized and thermally cracked and some coke is formed on the solid particles. The hot gases are suctioned from the zone for recovery and treatment. The coked solids are discharged from the second end of the vaporization zone by means of a helical chute extending through the closure plate at the second end of the inner tube. The coked solids are discharged into the second end of the annular space.

The annular space provides combustion and cooling zones extending sequentially from the second end to the first end thereof. Air is injected through the second stationary end frame into the combustion zone. In addition, a gas burner also extends through the second end frame and supplies supplemental heat to the combustion zone. Lifters, extending inwardly from the inner surface of the outer tube along its length, lift and drop the coked solids through the injected air stream. In the course of this, the coke combusts and the solids are further heated. The majority of the heat is retained within by a refractory insulating layer, extending essentially along the length of the inside surface of the outer tube. The resulting hot solids are advanced longitudinally through the annular space from its second end toward its first end. A portion of these hot solids are recycled, by means of a chute, from the first end of the combustion zone into the first end of the vaporization zone, as was previously described. The balance of the hot solids advance into the annular cooling zone, which is coextensive with the preheat zone of the inner tube. Here the hot solids are repeatedly lifted and dropped onto the outer surface of the preheat section of the inner tube. Thus the preheat section is heated by contact with the shower of hot solids and the flow of hot flue gases moving through the cooling zone. At the same time the hot solids and gases are correspondingly cooled, thus recovering useful heat from them. The gases produced in the annular space are suctioned out and the cooled solids are discharged from the cooling zone through the first end frame by means of a chute.

The ATP process and apparatus is then characterized by a cool outer member, within which is supported a heavy, metal inner member which experiences significant thermal effects over its length. The contents of the inner member rise in temperature from about ambient temperatures of 70° F. at its first end, to elevated temperatures of about 1000° F. at its second end. The annular space formed between the members provides an environment which has a corresponding temperature profile of about 650° to 1350° F. More particularly, the metallic wall of the inner member thus rises in temperature from about 600° to 1100° F. The internally insulated, metal outer member generally operates at a relatively uniform and cool 200° F., thereby minimizing heat losses and permitting drive components to be mounted thereto.

It is important to note that most materials, and particularly metals, possess a characteristic whereby the material expands and contracts as its temperature changes, generally expanding with temperature increase.

This then introduces a dilemma facing the designer of an inner and outer tube interconnecting means, wherein the differing temperatures therebetween result in severe differential thermal expansion effects. The inner tube thermally expands a greater amount than does the outer tube when operating in the hot mode, yet the outer tube must nonetheless be successfully and structurally connected together with some means extending through the annular space.

This differential thermal expansion is further aggravated by exposure of the actual interconnecting means to high temperatures. The interconnecting means itself expands a significant amount radially outwards, beyond the capability of the outer tube to respond.

If the differential thermal expansion is not compensated for, then yield stresses develop in the inner or outer tubes or the interconnecting means. If immediate failure does not occur, then subsequently, when these stresses are further superimposed on alternating stresses from the rotating action of the process, premature fatigue failure can result.

In early experimentation with a pilot-scale processor, the problem of differential thermal expansion was recognized but not successfully dealt with. Supports were attempted at three places; one main support at about the centre of the outer tube, and two others near each of the first and second ends of the inner tubes.

The first end of the inner tubular member was supported by spring washer-loaded support posts. These eventually failed and solid posts were welded in place. This approach was subject to eventual cracking of the weld sites. The support of the second end of the inner tubular member was originally a group of similar spring washer-loaded, inclined, multiple post supports. This latter assembly eventually failed as well and was replaced by multiple vertical post supports welded to the two tubular members.

The original configuration of a main, central connection of the inner and outer tubular members at the junction of the pre-heat and reaction zones was a leaf spring connected structure wherein differential radial motion flexed the springs in one plane, while inner member support was provided by the stiff section of the spring in the other plane. After significant operation, inspection of this area revealed cracked welds. Modifications were made to this area. More particularly, a plurality of internal pins, which were slidably receptive of radial growth, were installed but were restrained from axial and torsional movements by thrust blocks. This system lasted only a short time before the welds failed. Another modification was made. This second system involved a solidly welded structure offering some radial flexibility due to outer member solid blocks being welded in the middle of a wide flange which was radially offset and subsequently welded at either edge to the inner member. Post operation inspection has not yet revealed cracking at the connection sites, albeit at a low number of fatigue cycles for commercial acceptance.

Investigation of alternate design aspects for this main support area resulted in the conception of several solutions involving uncoupling the inner and outer tubular members and enabling free and independent movement of the tubular members in a radial direction with respect to each other, while preventing movement in the axial and rotational directions. These concepts produced mechanically complex arrangements, with link and pivot components prone to wear and a requirement for periodic replacement.

Recognizing the inherent simplicity and mechanical security of the rigid connection, it was determined that the key was not to accept differential radial expansion and work around it but to work with it and manipulate the intensity of differential movement.

SUMMARY OF THE INVENTION

In accordance with the present invention, an annular inter-tubular member connecting means is provided, for the main, substantially central support of a processor of the type hereinabove described, to alleviate the problems arising from differential thermal expansions and contractions which characterize hot inner and cooler outer tubular members. As previously stated, the outer tubular member is internally insulated with refractory. The outer metal member thus remains relatively cool and its expansion or contraction due to thermal effects is relatively minor. However, the inner metal tubular member is within the insulation and expands and contracts significantly when the processor changes between the operative hot and inoperative cold modes.

The solution to the differential expansion problem is not to apply mechanical devices to accept relative differential radial movement but is to manipulate the magnitude of expansion of each of the components of the structure to neutralize and redirect the expansion.

In a broad form of the invention, the magnitude of the differential thermal expansion is manipulated by: compensatory adjustments to the materials' coefficients of thermal expansion; by reducing the variation between differing temperature regimes with cooling and insulating means; or by a combination thereof.

In a first aspect, a rigid spoke support was developed in which the differential thermal expansion was manipulated by making compensatory selections of the materials' coefficients of thermal expansion. The radially extending spokes inter-connect the inner and outer tubular members, thus locking them together for rotation as a unit, pinning them together to prevent relative axial displacement, and to support and centralize the inner within the outer member.

The characteristics of the materials of construction of the inner and outer members and the interconnecting means were chosen so that the materials in use at high temperatures have low coefficients of expansion and materials at low temperatures have relatively higher coefficients of expansion. In this way, areas which were at high temperature would have the magnitude of their thermal expansion reduced, and areas which were at lower temperatures would have the magnitude of their thermal expansion enhanced. Thus the wall sections of the inner and outer tubular members, and the connecting means would be designed to expand and contract substantially the same amount when they were at the different temperatures to which the tubular members are typically subjected.

More particularly, the complementary materials support means comprises:

a plurality of radially extending spokes, interconnecting the inner and outer members, each member being subjected to a different temperature relative to each other; and the hot inner member and spokes being manufactured of a material having a lower coefficient of expansion than the material of the cooler outer member, the inner and outer members therefore being adapted to expand and contract substantially the same amount for reduction of differential expansion induced stresses.

In general applications, however, use of complementary materials can be shown to only compensate for a limited range of structures and temperature differentials: For example, for an outer member having twice the radius of an inner member, and also having a coefficient of thermal expansion of about 1.5 times that for the inner member (typical for austenitic stainless steel versus mild or ferritic steels), the acceptable differential in the magnitude of the rise in temperatures (between cold and hot operating modes) between the inner and outer members is limited to less than about 3 times before the complementary characteristics no longer compensate satisfactorily.

In a second aspect, temperature profiling the radially extending spokes is provided. The radially differing temperature regimes of the inner and outer members are manipulated, or profiled, to be more comparable using a system of air-cooling means and insulation. As a result, the relative differential thermal expansion between the inner and outer members is reduced or neutralized.

Temperature profiling is accomplished by cooling of the hotter components and preferably assisted by heating of the cooler components.

Cooling of hot components is achieved by flowing relatively cool air, from without the outer member, through passageways formed in the radial spokes, and into an annular-shaped air plenum. The plenum serves to collect incoming cooling air from some spokes and guide it for discharge from others. The air cools the material of the externally insulated spokes and the wall area of the inner member, closest to the spoke connection.

The outer member is preferably raised in temperature by adjusting the insulating means of the outer member.

The temperature differential is thereby reduced between the inner and outer members and is instead redirected in the axial direction, thereby forming a temperature gradient along the tubular members. It is known that temperature gradients along the axial direction of a tubular member produce low thermally induced stresses when the slope of the gradient is sufficiently gradual and the tube wall thickness is thin compared to its diameter, such as is the case in the ATP Processor.

More particularly, the connecting means comprises:

a plurality of radially extending spokes, interconnecting the inner and outer members, each member being subjected to a different temperature relative to the other;

said spokes being hollow, thereby forming radial passageways within for the flow of cooling air from a source external to the outer member, to an internal annular air plenum means;

means for externally insulating the spokes to permit the cooling air to cool the structural material of the spoke and part of the inner member immediately adjacent to the spoke, to a temperature approaching that of the outer member, and preferably means for insulating the outer member near the spoke to locally increase the outer member temperature, thereby reducing thermally induced differential stresses;

said annular air plenum means being connected to the radial spokes and being operative to interconnect the individual radial passageways, for collecting the incoming flow of cooling air from one or more of the radial passageways to be discharged through others while hermetically isolating the air from the inner member and annular spaces; and preferably means for insulating the annular air plenum means to further protect the cooling air flow from excessive heating.

The inner member to outer member temperature differentials are often greater than those that may be fully compensated for by either the use of materials of complementary expansion characteristics alone or by temperature profiling with air-cooling. In practice, the effects of operating process upsets need to be recognised and dealt-with, where temperature differentials may be different than were anticipated.

Therefore, in a third aspect, the features of complementary materials and temperature profiling may optimally be combined to tailor a solution to the individual demands of different processor implementations, design requirements, and process upsets.

Figure 1:
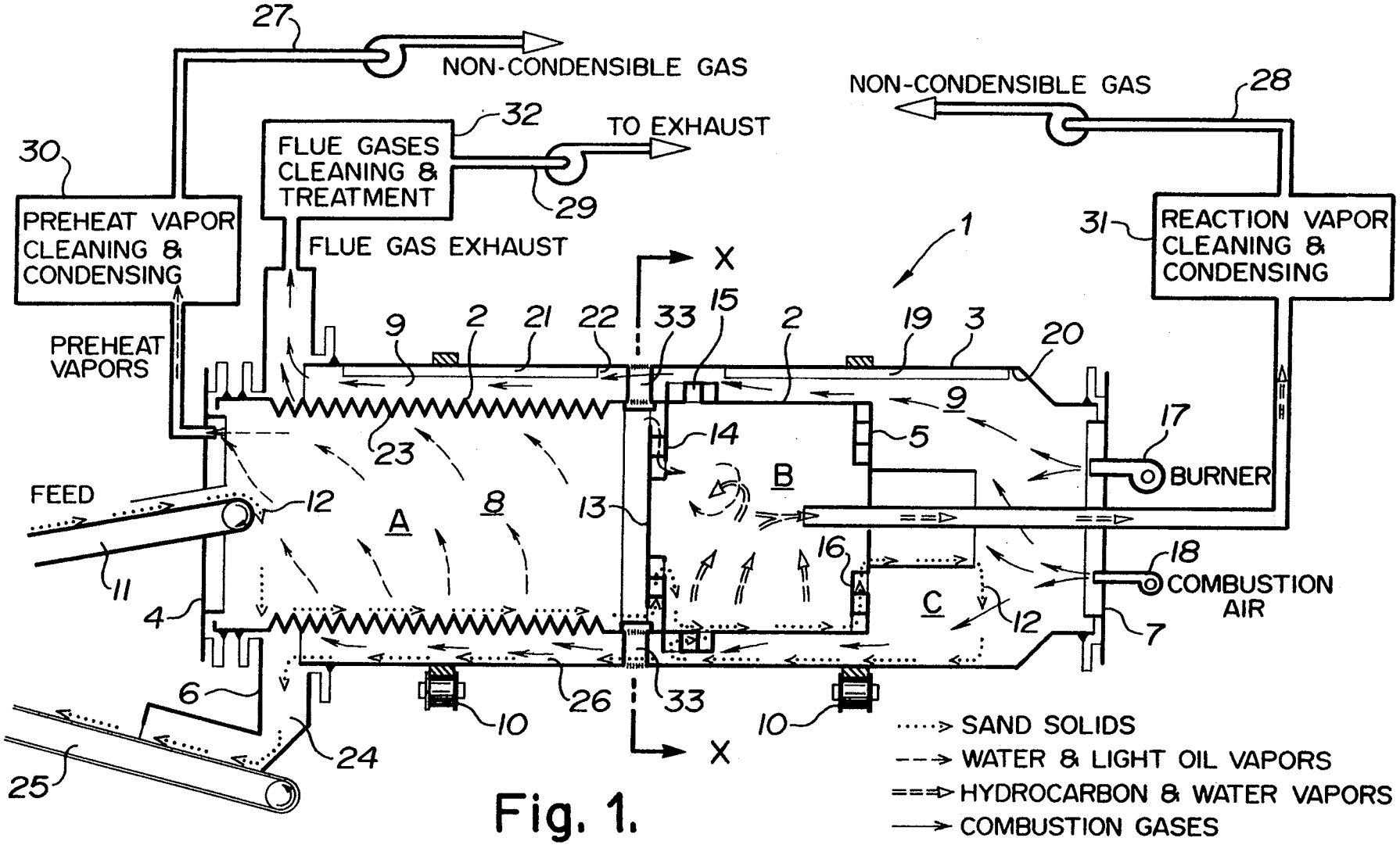
FIG. 1 is a schematic drawing showing the ATP Processor and auxiliary systems in side elevation.
Figures 6A, 6B, 6C, 6D, 6E, 6F, 6G:
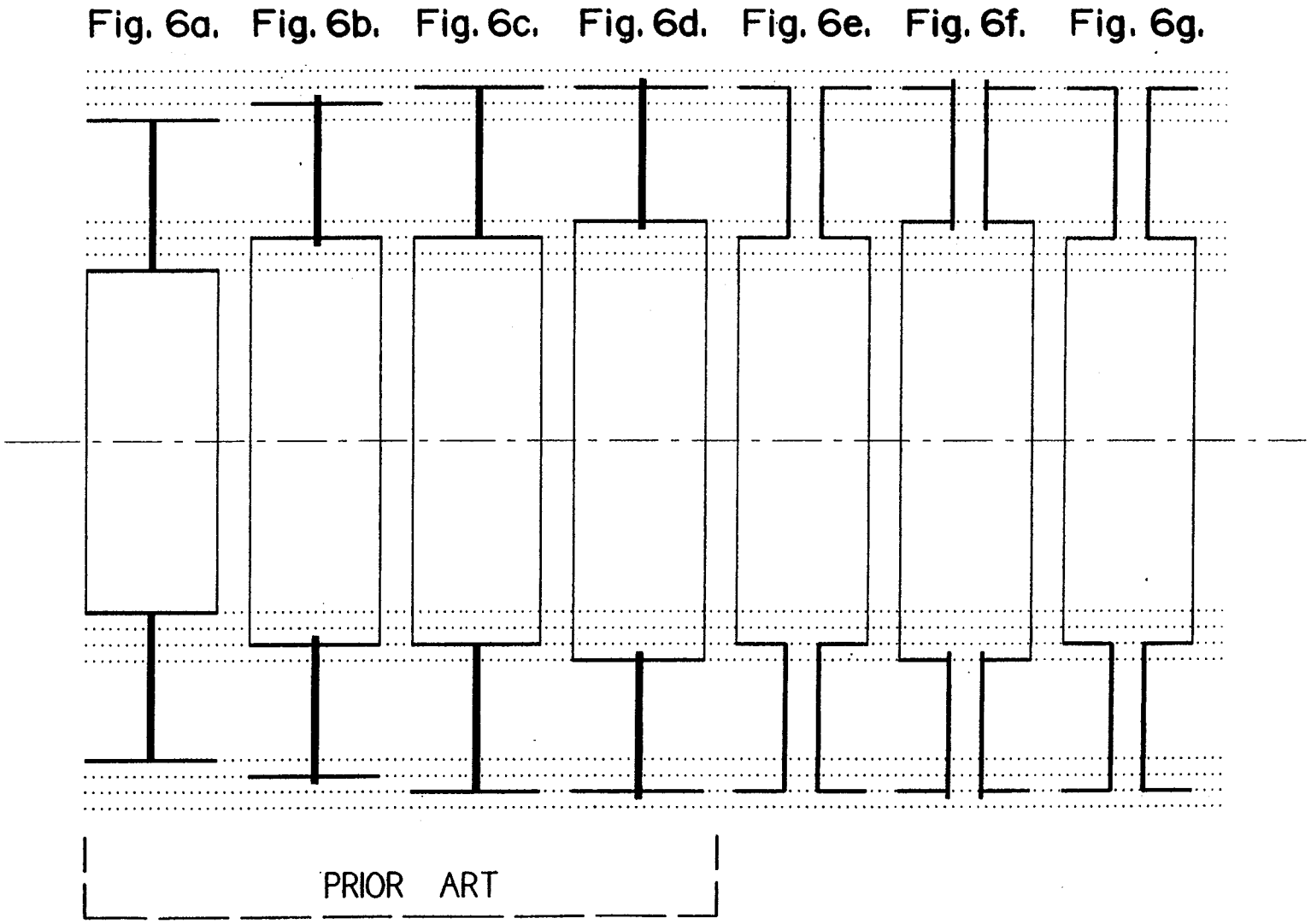
Fig. 6g. PRIOR ART
FIG. 6 is a series of sub-FIGS. 6*a* through 6*g* showing the free, relative thermal growth of the inner and outer tubular members with respect to a radial spoke and the centerline of the tubular members.
Figure 7:
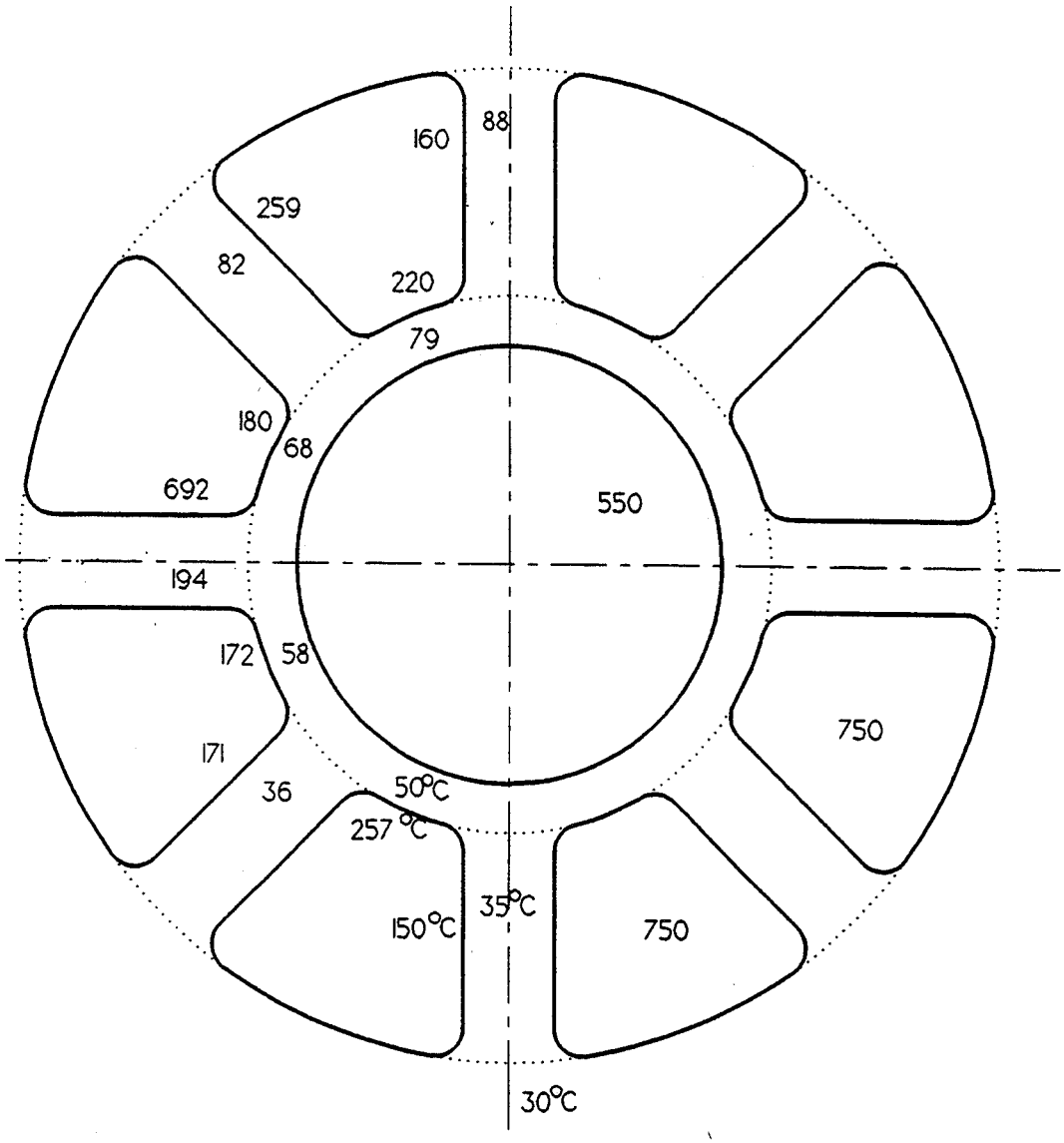

Sub-figure 6*a* specifically illustrates the inner and outer members in a cold condition;

Sub-figure 6*b* demonstrates the hot operating condition with no attempt to compensate for differential expansion;

Sub-figure 6*c* demonstrates the hot operating condition, successfully using complementary materials of construction and a heated outer member for compensation;

Sub-figure 6*d* demonstrates the very hot operating condition, unsuccessfully using complementary materials of construction and a heated outer member for compensation;

Sub-figure 6*e* demonstrates the hot operating condition, successfully using air-cooling and a heated outer member for compensation;

Sub-figure 6*f* demonstrates the very hot operating condition, unsuccessfully using air-cooling and a heated outer member for compensation;

Sub-figure 6*g* demonstrates the very hot operating condition, successfully using the combination of complementary materials of construction, air-cooling and a heated outer member for compensation; and FIG. 7 presents computer modelled thermal profiles of air, spoke wall and inner member wall temperatures on a cross section of the annular support of the present invention, sectioned along line X—X according to FIG. 1.

DETAILED DESCRIPTION OF THE PREFERRED EMBODIMENT

Referring to FIG. 1, an ATP processor 1 comprises inner and outer tubular members 2 and 3. The first end of the inner tubular member 2, is sealed by a first stationary end frame 4. The second end of the inner tubular member 2 is sealed by closure plate 5. The first and second ends of the outer tubular member 3 are sealed by a second and third stationary end frame, 6 and 7 respectively.

The inner tubular member 2 forms an internal passageway 8 which consists of sequential preheat and vaporization zones A and B extending between said member's first and second ends.

The outer tubular member 3 is generally coextensive, concentric and radially outwardly spaced from the inner tubular member 2. An annular space 9 is thus formed between the tubular members 2 and 3. This space 9 comprises combustion and cooling zones C and D extending sequentially between the second and first ends of the outer tubular member 3.

A drive and support system 10 is provided for rotating the outer tubular member 3 about its longitudinal axis.

The invention comprises apparatus, described in detail later, for structurally interconnecting the tubular members 2 and 3 so that they rotate together.

The preheat zone A begins at the first end of the inner tubular member 2 and accepts solids introduced by a feed conveyor 11 which projects through the end frame 4. The incoming solids 12 are heated through countercurrent heat exchange with the cooling zone D, ultimately discharging preheated solids to a vaporization zone B.

The preheat zone A solids increase in temperature from ambient feed conditions of about 70° F. to a zone discharge temperature of about 600° F.

The vaporization zone B serves to vaporize and thermally crack volatile organic materials. It is physically separated from the preheat zone A by a baffle plate 13. An open-ended chute 14 extends through the baffle 13 for conveying preheated solids 12 therethrough.

An open-ended chute 15 passes through the inner member 2 at the vaporization zone B to receive recycled hot solids from the combustion zone C and mix them with the preheated solids from the preheat zone A. The hot solids boost the temperature of the mixed solids to about 1000° F.

The vaporization zone B is bounded at its discharge with the closure plate 5, which includes an open-ended chute 16 for moving coked solids (a by-product of the reaction which occurs in the vaporization zone) to the second end of the outer member 3 which is the beginning of the combustion zone C.

The combustion zone C comprises that portion of the annular space 9 which exists essentially co-extensive with the vaporization zone B.

A burner 17 and an air fan assembly 18 extend through the third end frame 7, for supplying supplemental heat and coke combustion air to the combustion zone C.

Lifters 19 are provided, attached to the wall 20 of the outer tubular member 3 along its inside surface, throughout the length of the combustion zone C. The lifters 19 are adapted to lift and cascade coked solids, thereby exposing them to the air supplied by the air fan assembly 18 and initiating combustion of the coke to raise the temperature of the solids particles to about 1350° F.

As described above, some of the hot solids issuing from the combustion zone C are recycled into the first end of the vaporization zone B through the open-ended chutes 15. The balance of the hot solids are advanced into the cooling zone D.

The cooling zone D comprises that portion of the annular space 9 which exists essentially co-extensive with the preheat zone A.

Lifters 21 are also provided in the cooling zone D, attached to the wall 22 of the outer tubular member 3 at its inside surface. The lifters 21 are adapted to lift the hot solids moving through the zone and drop them on the preheat wall portion 23 of the inner tubular member 2, thus providing countercurrent heat exchange with the preheat zone A.

Simultaneously with the increase in temperature of the preheat zone A, the solids and gases in the cooling zone D are progressively cooled as they move between its second and first ends, from about 1350° F. to about 650° F.

Typically, as the inner member 2 transfers heat between the annular space 9 and the solids contents 12 carried within the inner member, the temperature of the member will vary from about 600° to 1100° F., from its first to its second ends.

Finally, the cooled solids issuing from the first end of the cooling zone D pass through an outlet 24 in the second end frame 6 and are discharged by conveyor assemblies 25 as tailings.

To minimize heat losses and to protect drive and support system 10 and other assemblies which are mounted external to the outer tube, refractory insulation 26 is provided, installed internal to the outer tubular member 3, thereby keeping it relatively cool.

Typically, the outer tubular member temperature will be about 200° F., varying somewhat with the temperature of the annular space 9 within.

Mass flow of solids throughout the zones of the ATP processor are achieved by a combination of the rotating action of the processor, the hydraulic gradient of contained particulate solids, and through appropriately located advancing element means.

Two gas compressor and conduit assemblies 27,28 are provided to suction gases from the first end of the preheat zone A and the second end of the vaporization zone B, respectively. A fan and conduit assembly 29, is provided to suction gases from the first end of the cooling zone D.

The gases removed from the preheat zone A through assembly 27 are condensed in a first condenser 30. The gases removed from the vaporization zone B through assembly 28 are condensed in a second condenser 31. The flue gases are removed by the assembly 29 from the first end of the cooling zone D, are cleaned in solids removal equipment 32 and are vented.

In summary, the apparatus of the ATP Processor provides a heavy, hot inner tubular member 2 and a cool outer tubular member 3. Conduction of heat through to the preheat zone A and routing of hot annular solids to the vaporization zone B causes an increase of the temperature of the charge in the inner tubular member from about 600° F. at its first end to about 1100° F. at its second end. The outer tubular member 3 is maintained at about 200° F. along its length.

The structural aspects of maintaining the integrity of the inner and outer tubular members 2, 3 in the varying thermal environments imposed, as described above, are significant. Nonetheless, for the inner tubular member 2 to rotate, it must be interconnected with some means to the outer tubular member 3.

The inner and outer tubular members 2,3 are constructed of metal. Metal characteristically expands and contracts with changes in temperature. As the inner and outer tubular members are subjected to differing temperature regimes at any particular longitudinal location along the members lengths, the amount of expansion and contraction will be different.

When raised to hot operating mode, the inner tubular member 2 becomes hotter than the outer member 3 and therefore expands radially and longitudinally at greater rates. The magnitude of the loads are such that a cantilevered inner member from a single support is not feasible. Thus a main support 33 is provided, at about the mid-point of the co-extending length of the inner and outer tubular members 2, 3. This support 33 defines a neutral longitudinal reference point. The inner tubular member 2 is then permitted to expand axially either direction away from this reference. Auxiliary supports (not shown) may be installed at the first and second ends of the inner member 2, which need only to support a portion of the inner members weight.

The main support 33, and the subject of the preferred embodiment, acts to fix an axial datum and need only deal with the radial expansion. Being in a central position, the support 33 must be strong enough to carry a significant portion of the inner member 2 gravity loads and impart the necessary rotational action.

The differential radial expansion which occurs between the hot inner and cooler outer tubular members 2,3 results in changes to the absolute distance between their wall surfaces. The amount of change is dependent upon the change in temperature of the material of the tubes and of a characteristic of the material referred to as the thermal coefficient of expansion ($\alpha$) which is usually defined as a relative change in length per incremental change in temperature (i.e. in/in/° F).

As the tubular members 2,3 are initially heated from ambient conditions to operating conditions, the metal expands and they increase in diameter. If the hot inner member 2 were not physically connected to the cooler outer member 3, then the inner member would expand or move a greater absolute radial distance, greater than that of the outer member. The absolute distance of radial movement (d) may be physically defined by $d=r\times\alpha\times\Delta T$ where r is the radius of the tube and $\Delta T$ is the change in temperature. If for example, the radius of the outer member 3 is twice the inner member 2 and the temperature of the inner member is 3 times that of the outer member and further that the materials of construction are the same, then it may be shown that the inner member would freely expand twice the distance of the outer. When the inner and outer members are physically connected, this differential movement is not "free" and results in yield stresses and structural failure of the points of connection.

This then describes the dilemma of structurally interconnecting the inner and outer tubular members 2,3. This means for interconnection must be capable of supporting the inner member yet adapt to the variable thermal regimes and the resultant expansion and contraction characteristics.

As described previously, a rigid connection was a desirable goal with promises of security and simplicity.

Figure 2:
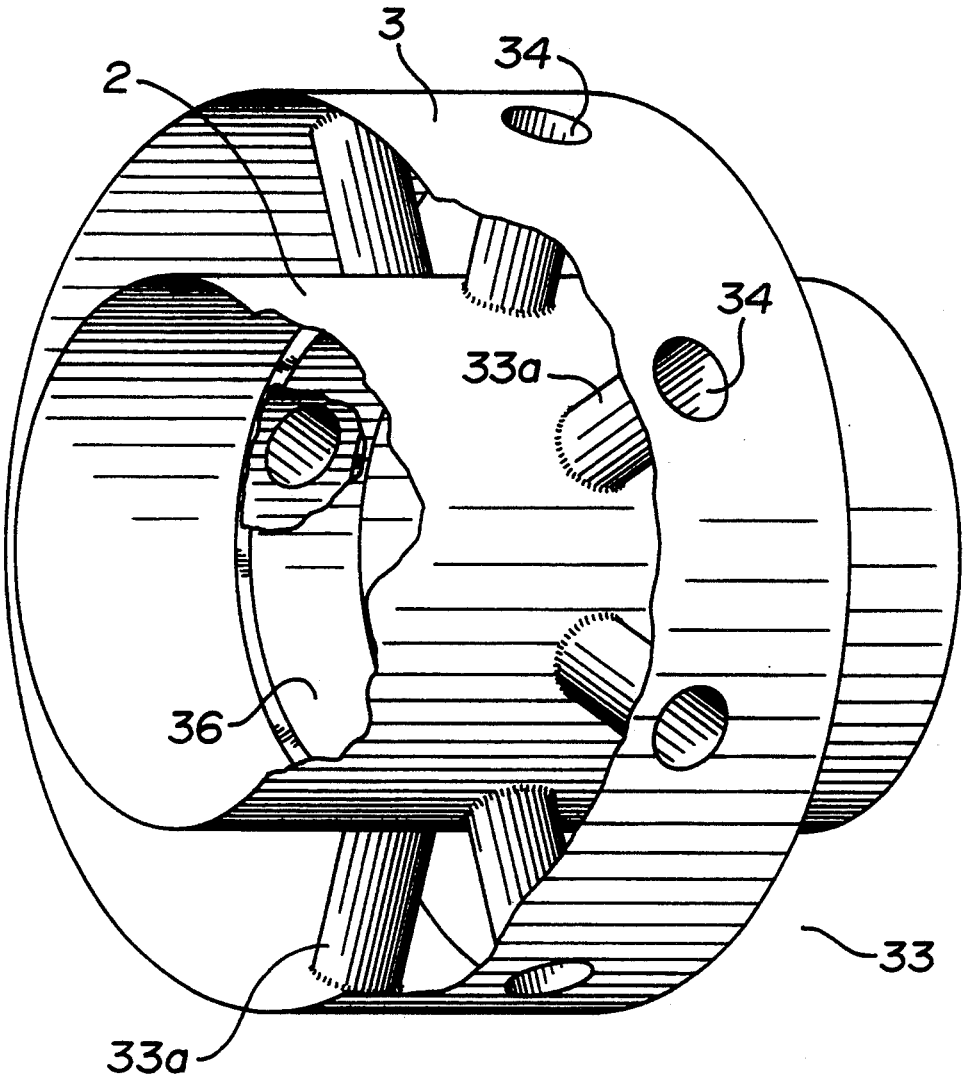
FIG. 2 is a perspective, partly broken away view showing the inner tubular member, plenum, spokes and outer tubular member in the annular support area.
Figure 3:
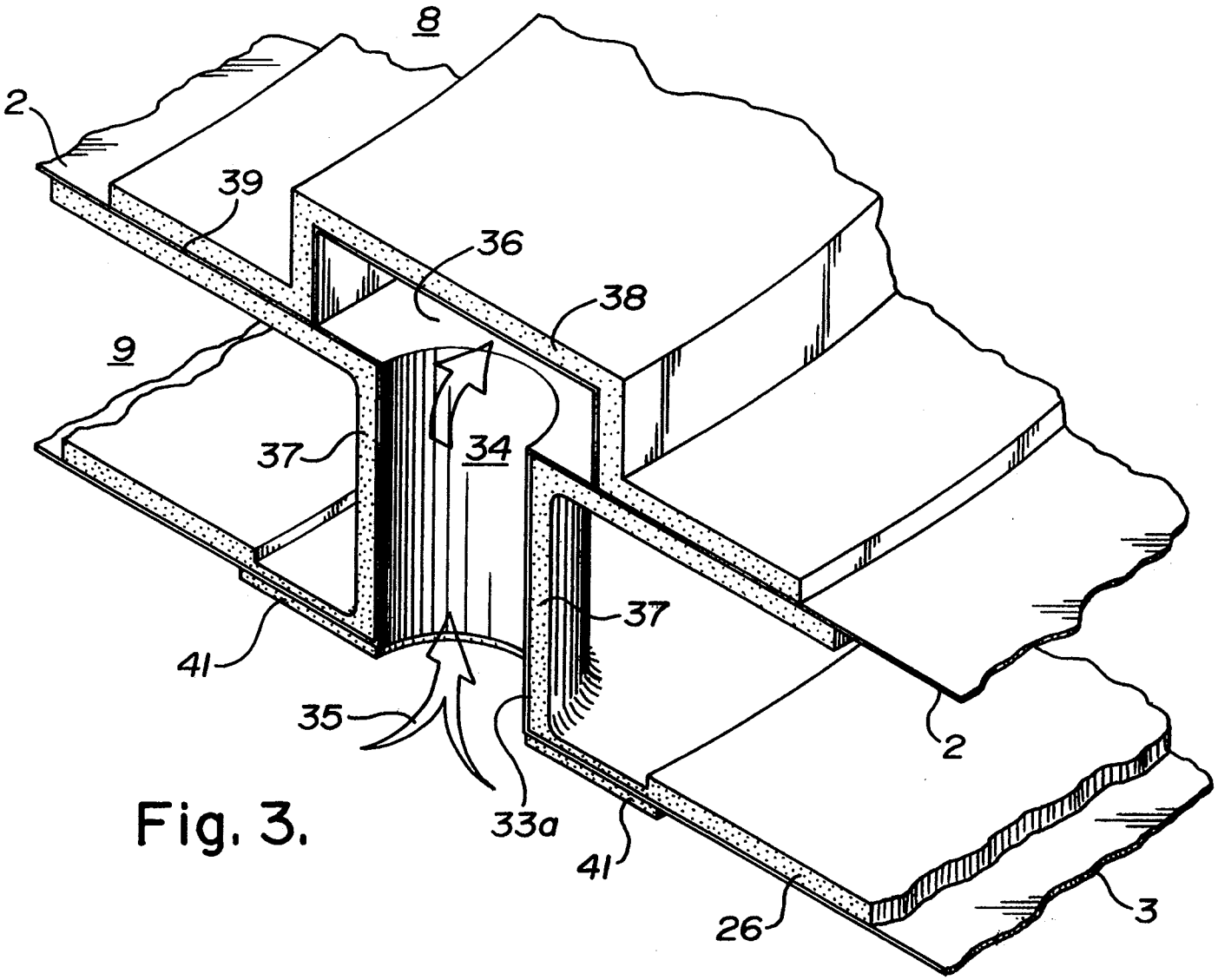
FIG. 3 is a perspective, sectional view showing a spoke and the plenum in association with the inner and outer tubular members.

Referring to FIGS. 2 and 3, a plurality of spokes **33*a* are joined to the inner member 2 and extend outwardly and radially from it, rigidly connecting the inner member 2 to the outer member 3. Thus the inner and outer members 2,3 are pinned together at this central point along the length of the ATP processor 1, so that one may not shift axially relative to the other. The inner member 2 is suspended concentrically within the outer member 3. A drive connection is supplied from the outer to the inner member 3, 2** so that they rotate as one.

Three embodiments for a structural connection are presented: using a technique of complementary materials of construction; using temperature profiling; and using a combination of both techniques.

In a first embodiment, the inner member 2, the spokes **33*a* and outer tubular member 3, in the area of the spokes, are formed of complementary materials so that the magnitude of thermal expansion for each of the structural components is about equal. The spokes 33*a* and the inner member 2 may be constructed from a 400 series ferritic stainless steel, and the outer member 3** of an austenitic 300 series stainless steel, having relative coefficients of thermal expansion of about 6.7/10.

The inner member 2 and spokes **33*a* elongate or contract as the outer member 3** also expands and contracts radially at a complementary rate, due to the appropriate selection and use of material of construction.

Using the relationships of expansion and temperature disclosed above, and applying typical operating values, one may determine the upper limits of differential thermal temperatures which may be achieved using typical materials of construction. Due to the large quantity of material required and the loads and temperatures at which they are subjected, stainless steels and the like are used for the hot internals. Common austenitic stainless steels have a high coefficient of expansion $\alpha$, of about $10\times10^{-6}$ in/in/° F. (at the temperatures of interest) and ferritic stainless steels have a lower coefficient of expansion, similar to that of mild carbon steel of about $6.7\times10^{-6}$ in/in/° F. (for the temperatures of interest). Using the diametral dimension of an outer tubular member $r_o$ of two times the inner tubular member $r_i$, and choosing the materials for the inner and outer tubular members to have a ratio of coefficients of expansion $\alpha_i/\alpha_o$ of 6.7/10, then the net expansion of the walls of the inner and outer members is $d_i-d_o=r_i\times\alpha_1\times\Delta T_i-r_o\times\alpha_o\times\Delta T_o$. The desired result is that the net expansion=zero or that $d_i=d_o$. By substituting in the known ratios of $\alpha_1/\alpha_o$ and $r_i/r_o$, one may determine that the net expansion is zero when $\Delta T_i/\Delta T_o$ is about 3 times. In other words, when the increase in temperature from the cold to the hot operating mode of the inner member is 450° F. (50° to 500° F.) and that of the outer member is 150° F. (50° to 200° F.), then the expansions are perfectly matched and no differential thermal expansion stresses will occur.

Higher inner member temperatures may be compensated for by causing the outer member temperature to increase locally at the area of the support, thus maintaining the 3 times relationship. By contouring or thinning the internal insulation of the outer member 3, or by applying external insulation 41 to retain heat, the outer member temperature increases, thereby increasing the magnitude of its expansion. Referring to Table 1, it may be seen that significant benefits for increased inner member 2 temperatures are achieved by raising the temperature of the outer member 3. By raising the outer member temperature from 200° to 350° F., the inner member hot operating temperature may reach 950° F. and still result in equal magnitudes of expansion with the outer member.

TABLE 1

| OUTER MEMBER | $\Delta T_o$ | INNER MEMBER | $\Delta T_i$ |
|---|---|---|---|
| 50 to 200° F. | 150° F. | 50 to 500° F. | 450° F. |
| 50 to 250 | 200 | 50 to 650 | 600 |
| 50 to 300 | 250 | 50 to 800 | 750 |
| 50 to 350 | 300 | 50 to 950 | 900 |

Even with this improved range of operability, it is often not enough to counteract the high temperature effect of the annular space 9 on the radial spokes 33*a*. The radial spokes, if positioned within the combustion zone C, could reach 1350° F., requiring outer member 3 temperatures of nearly 500° F. Whether or not the differential expansion may be compensated for, often these temperatures sufficiently reduce the structural strength of the materials to unacceptable levels thus limiting the choices of materials so that complementary choices are no longer available or economically feasible. For example, the use of low expansion mild steel internal components is not suggested over 800° F. and ferritic stainless steels can suffer degenerative metallurgical effects at similarly high temperatures.

In a second embodiment, the spokes 33*a* are hollow, each forming a radial passageway 34 capable of passing cooling air 35 from without the outer member 3 to an annular air plenum 36 within the inner member 2, thus cooling the spokes. The cool outer air may enter either by natural or forced means. Air generally enters in lower oriented spoke passageways 34 and exits from upper oriented passageways. Fan means may be employed to enhance the heat transfer rate and distribution of cooling air 35 though the spokes 33*a*.

The annular air plenum 36 serves to collect cooling air 35 from one or more of the spokes 33*a* and deliver it to others for exhausting outside the outer member 3.

The cooling air 35 absorbs heat from the inner wall surfaces of the spokes 33*a*, reducing the temperature of the material of the spokes. Ideally, it may be recognized that a high rate of cooling could equalize the temperatures of the spokes 33*a* to those of the outer member 3. If this were accomplished then no differential expansion would occur and no associated thermal stresses would develop.

To assist in cooling, a system of external insulation 37 is applied to the spokes 33*a*, thus permitting a temperature gradient to develop across the insulation 37. The material of the spoke is cooled and assumes a temperature much lower than the annular space 9 through which it passes. Preferably, the air plenum 36 is also fitted with insulation 38 to reduce heat buildup of the collected air.

Since the material of the spoke 33*a* is cooled, and it is connected to the inner member 2, the inner member itself immediate to the spoke is also cooled. This forces a temperature gradient to form in the axial portion 39 of the inner member 2 as it rises to resume its natural temperature. It is known that temperature gradients along the axial direction of a tubular member produce low thermally induced stresses when the slope of the gradient is sufficiently gradual and the tube wall thickness is thin compared to its diameter. Preferably, this gradient may be controlled with insulation means 40.

Thus, cooling of the radial spokes has permitted cooling of previously high temperature internal structural components to levels more comparable to those of the outer member, resulting in substantially equivalent magnitudes of expansion even when identical materials of construction are used throughout.

Preferably, a similarly as in the first embodiment, the temperature of the outer member 3 can also be elevated, to reduce the amount of cooling required and to lessen the severity of the temperature gradient that is developed along the inner tubular member 2.

In some implementations of the support, it may not be possible to practically achieve sufficient cooling to match the temperatures of the spoke and the inner and outer members close enough to lower induced stresses. Considering the individual limitations of either of the temperature profiling or use of complementary materials, an alternate, more flexible solution is presented. Preferably, in these situations, a combination of air-cooling and complementary materials of construction would be used. Advantages include:

- a greater selection of internal structural materials at the lower air-cooled temperatures;
- greater mechanical and process design options through increased control over temperatures;
- reduced cooling requirements;
- reduced thermal gradients in the axial portions of the members.

Referring to FIGS. 6*a* through 6*g*, one may see the how the individual and combined features of complementary materials and air-cooling materials affect differential radial expansion referenced from cool conditions. The effects of mismatched expansion are shown as exaggerated expansive displacements of "free-moving" inner and outer members relative to a radial spoke. Mismatched ends of the spoke relative to the members indicate inadequate compensation for differential expansion and a high possibility of mechanical failure. Dotted guide lines are illustrated to shown relative expansions in response to differing temperature regimes.

FIG. 6*a* presents the cold operating condition for any support solution.

FIGS. 6*b*, 6*c* and 6*d* present the use of complementary materials of construction and its response to combinations of hot and very hot inner member operating conditions and to manipulation of the outer member temperature.

FIGS. 6*e* and 6*f* present the air cooling embodiment and its response to hot and very hot operating conditions.

Finally, FIG. 6g presents a combination of air-cooling and complementary materials and their response to the very hot operating condition.

Table 2 provides a legend to FIGS. 6a through 6g. A comment is noted whether or not the support was able to compensate adequately or not.

TABLE 2

| FIG. # | 6a | 6b | 6c | 6d | 6e | 6f | 6g |
|---|---|---|---|---|---|---|---|
| Support Type | Any | Compl | Compl | Compl | Air-Cool | Air-Cool | Combine. |
| INNER MEMBER | | | | | | | |
| Temp. regime | Cold | Hot | Hot | V. Hot | Hot | V. Hot | V. Hot |
| Coeff. Exp. | L/H | High | Low | Low | High | High | Low |
| Structure T | Cold | Hot | Hot | V. Hot | Hot | Warm | Warm |
| OUTER MEMBER | | | | | | | |
| Temp. Regime | Cold | Cool | Cool | Cool | Cool | Cool | Cool |
| Coeff. Exp. | L/H | L/H | High | High | High | High | High |
| Structure T | Cold | Cool | Warm | Warm | Warm | Warm | Warm |
| SUPPORT Response | comp | NOT comp | comp | NOT comp | comp | NOT comp | comp |

Two examples are presented to illustrate the effectiveness and application of the present invention.

In Example I, computer modelling of an ATP Processor with air-cooled spokes is employed to predict temperature profiles for which differential thermal stresses are acceptable.

In Example II, operational results, for a support tested in a prototype ATP Processor, are presented in which a combination of complementary materials of construction and air-cooling is used.

EXAMPLE I

This example supports the second aspect of the invention, in that the temperature profiles of the spokes and the inner and outer members may be sufficiently manipulated with air-cooling to prevent excessive differential thermal expansion or contraction.

A computer model was developed to predict the extent and nature of the cooling in a multiple radial support, annular plenum system as described above. The model equates convective hydraulics of air in ducts to heat transfer in each of the spokes and the annular plenum.

A natural draft model of air through the passages of a non-rotating unit was used as the basis. Heat transfer characteristics about the perimeter of any duct section was assumed constant, though they can vary radially along the duct.

Rotation effects as they apply to pressure effects were applied to correct the static results. The rotational effects account for air inlet pressure losses and outlet gains, and the loss of head due to centrifugal forces on the cooling air column.

The temperatures of the spokes and of the cooling air were calculated by providing the following information:

| | |
|---|---|
| Number of radial spokes | 8 |
| Outer member diameter | 315 inches |
| Inner Member diameter | 173 inches |
| Radial dimension of annular plenum | 15.8 inches |
| Axial Width of annular plenum | 78 inches |
| Inside Diameter of Spoke | 29.5 inches |
| Bell-mouth radius of spoke inlet/outlet | 8.9 inches |
| Spoke material thickness | 2 inches |
| Spoke insulation thickness | 4 inches |
| Annular plenum material thickness | 2 inches |
| Annular plenum insulation | 4 inches |
| Rotational Speed | 4 rpm |

-continued

| | |
|---|---|
| Inner member passsageway temperature | 1022° F. |
| Annular space temperature | 1380° F. |
| Ambient cooling air temperature | 86° F. |
| Thermal Cond. of insulation | .07 Btu/(ft h °F.) |

As eight spokes are symmetrical, only one half of the structure was modelled.

Figure 5:
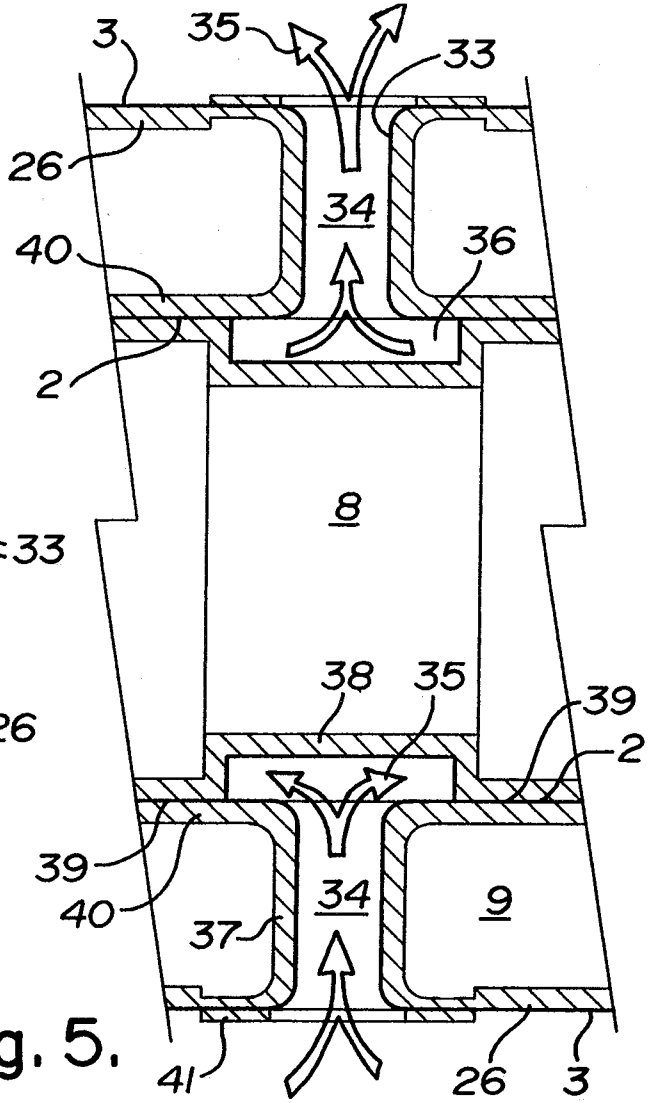
FIG. 5 is an axial cutaway section of the annular support of the present invention according to FIG. 1.
Figure 4:
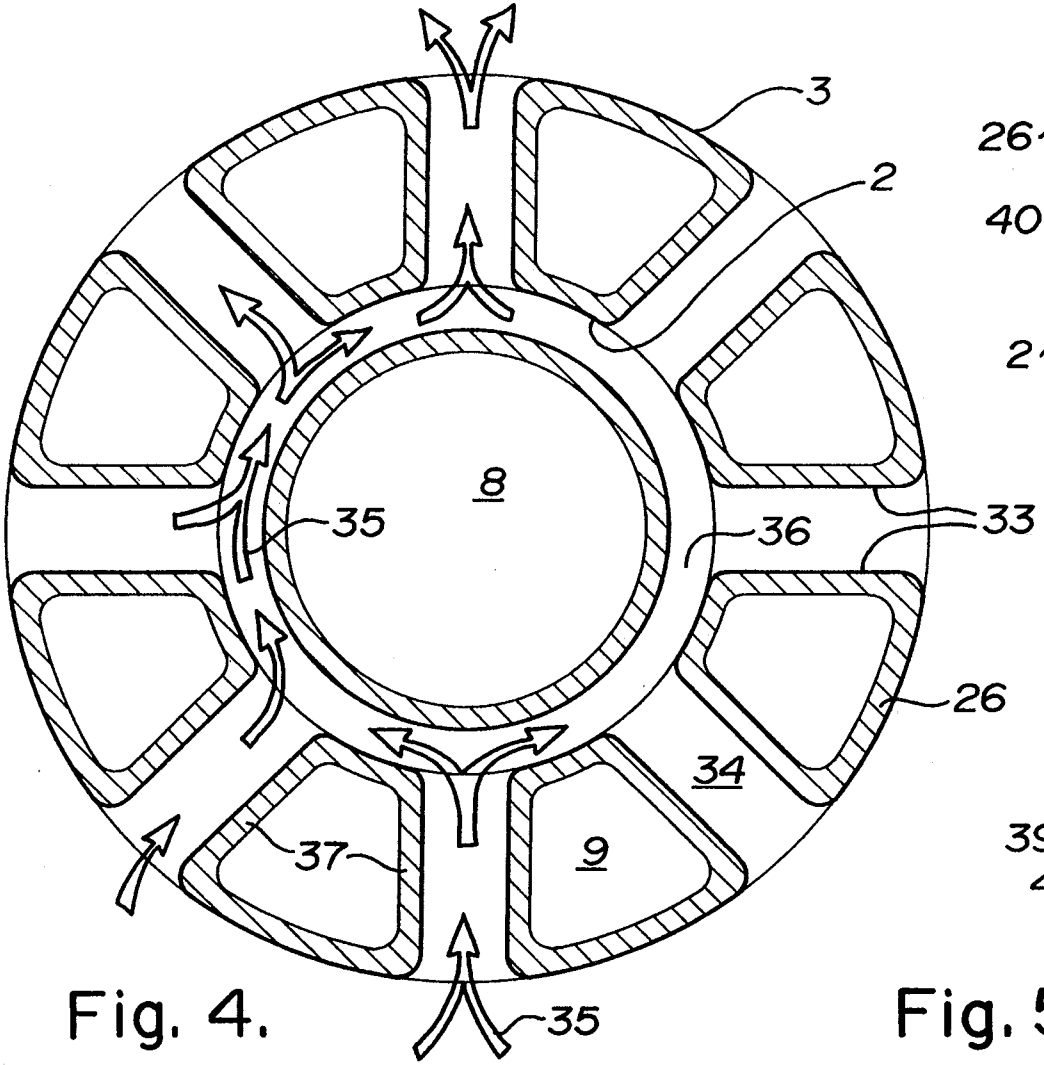
FIG. 4 is a cross section of the annular support of the present invention, sectioned along line X—X according to FIG. 1.

Referring to FIG. 5, a thermal profile is produced. The cooling air was determined to flow adequately under natural convective action, rising from lower spoke passageways, and exiting through upper passageways.

Note the steady increase in cooling air temperature from ambient 86° F. to 190° F. at the top exit.

The horizontal spoke showed anomalous results caused by stagnation and flow reversal occurring in the passageway. This discontinuity was a spike of short duration and is considered to have little impact on the overall model results.

Steady state temperatures were predicted to occur within 14 hours of operation. Considering that less than 4 seconds pass per 45 degrees of rotation, variable spoke temperatures are not expected to have significant individual influence. By averaging all the spoke wall data, excluding the anomalous results, one could conclude that the spoke wall temperatures would assume some nominal steady state temperature of about 400° F. This was an idealized value. A practical value of 525° F. is expected to provide conservative allowances for the temperature spike effects and operational variations.

The wall of the outer member can readily be heated to 400°–525° F. with insulation adjustments, thus neutralizing differential radial thermal stresses.

The above convective model was calibrated against actual data acquired from a prototype ATP Processor support, for which actual test data was acquired. The test data is presented in Example II.

EXAMPLE II

A small, portable ATP Processor was fitted with an eight radial spoke main support. The combined features of air-cooling and complementary materials of construction were used. The spokes were formed of ½ inch plate material, in a hollow rectangular shape thereby forming a passageways within. No bell-mouthing of the spoke inlets or outlets was provided. Further, central dividing fin/stiffeners were installed, running radially down the centre of each passageway.

The unit was operated at steady state thermal operation and then stopped suddenly to obtain direct surface temperatures. These temperatures were compared against the predicted results from the model as described in Example I.

The temperatures of the spokes and of the cooling air were calculated for the model by providing the following information:

| | |
|---|---|
| Number of radial spokes | 8 |
| Outer member diameter | 143.3 inches |
| Inner Member diameter | 70.9 inches |
| Radial dimension of annular plenum | 8 inches |
| Axial Width of annular plenum | 11 inches |
| Tangential width of Spoke | 5 inches |
| Axial width of Spoke | 11 inches |
| Spoke material thickness | 0.5 inches |
| Spoke insulation thickness | 2.5 inches |
| Annular plenum material thickness | 0.5 inches |
| Annular plenum insulation | 2.5 inches |
| Fin/stiffener thickness | 0.5 inches |
| Fin/stiffener weld factor | .9 — |
| Rotational Speed | 4.5 rpm |
| Inner member passageway temperature | 1110° F. |
| Annular space temperature | 1450° F. |
| Ambient cooling air temperature | 86° F. |
| Thermal Cond. of insulation | .10 Btu/(ft h °F.) |

The model generated a profile of average spoke temperatures which were about 180° F. lower than the measured temperatures. The actual temperatures were measured at an average of 680° F. and the model predicted 500° F.

Certainly the cooling capabilities of convective air flow through the spokes was confirmed. The spokes traversed the annular space temperature of 1450° F., and were cooled to 680° F.

The model results were considered reasonable due to variations in the operating structure and the capabilities of the computer model. The annular plenum was not insulated, resulting in additional heating of the spokes, not accounted for in the model. Actual surface temperature readings showed greater variations than expected, due in part to variations in the actual insulation of the spokes.

The outer member temperature was measured at 266° F. With an average spoke temperature of 680° F., the differential thermal expansion would have been severe if the materials coefficients of expansion were identical.

In this case, the connecting portion of the outer member was constructed of 304 Stainless Steel. The radial spokes and the connection portion of the inner member were constructed of a high strength alloy, EN30B (a British Steel Corp, Super S.H.N.C. variant of ASTRALLOY Gr 1, available from Bethlehem Steel Corp, Pa., U.S.A.). The EN30B alloy has a coefficient of thermal expansion similar to that of mild steel, being about 6.7/10 that of the austenitic 304 Stainless steel.

In summary, the cooling feature significantly reduced, but did not completely eliminate, the differential temperatures between the hot inner member and spokes, and the cooler outer member. The use of complementary materials was used to further alleviate the remaining differential thermal stresses.

Although the complementary materials were unable to fully compensate for the residual temperature differential, the induced stresses were low enough to complete over 1 million rotational cycles before non-critical fatigue cracking was detected.

The embodiments of the invention in which an exclusive property or privilege is claimed are defined as follows:

1. An interconnecting structural support in combination with a rotary processor having metal inner and outer tubular members, wherein the inner member is subjected to higher temperatures than the outer, said members being generally coextensive, concentric, and spaced apart, forming an annular space therebetween that is hot when the processor is operating, whereby the tubular members form a unitary rotatable tube assembly with the tubular members being thereby fixed together against relative axial displacement, the support comprising:

a plurality of radially extending spokes rigidly connecting the tubular members;

the inner tubular member and spokes being manufactured of a material having a lower coefficient of expansion than the material of the outer member, the inner tubular member and spokes being therefore adapted to expand and contract substantially the same amount as the wall section of the outer tubular member, for reduction of differential expansion induced stresses.

2. The interconnecting structural support as recited in claim 1 comprising insulating means wrapping the outer tubular member so that the temperature of the structural material of the outer member is adjusted upwards.

3. An interconnecting structural support in combination with a rotary processor having metal inner and outer tubular members, wherein the inner member is subjected to higher temperatures than the outer, said members being generally coextensive, concentric, and spaced apart, forming an annular space therebetween that is hot when the processor is operating, whereby the tubular members form a unitary rotatable tube assembly with the tubular members being thereby fixed together against relative axial displacement, the support comprising:

a plurality of radially extending spokes rigidly connecting the tubular members;

said spokes being hollow so that they form radial passageways within for the flow therethrough of cooling air from a source external to the outer member;

an annular air plenum means being mounted to the inner tubular member and connected to the radial spokes, said plenum means being operative to connect the spoke passageways so that it receives incoming flows of cooling air from some of the passageways and discharges the air through others of the passageways while hermetically isolating the air from the inner tubular member and annular space.

4. The interconnecting structural support as recited in claim 3 wherein:

the inner member and spokes are manufactured of a material having a lower coefficient of expansion than the material of the outer tubular member.

5. The interconnecting structural support as recited in claim 4 comprising:

each spoke being wrapped in thermal insulation so that a temperature gradient forms between the hot annulus and the spoke passageway.

* * * * *